US012680332B2

(12) United States Patent
Graber et al.

(10) Patent No.: US 12,680,332 B2
(45) Date of Patent: Jul. 14, 2026

(54) LATTICE ASSEMBLY

(71) Applicant: Permalatt Products, Inc., Bremen, IN (US)

(72) Inventors: Loren R. Graber, Nappanee, IN (US); Wendell J. Miller, Nappanee, IN (US)

(73) Assignee: Permalatt Products, Inc., Breman, IN (US)

( * ) Notice: Subject to any disclaimer, the term of this patent is extended or adjusted under 35 U.S.C. 154(b) by 286 days.

(21) Appl. No.: 18/483,786

(22) Filed: Oct. 10, 2023

(65) Prior Publication Data

US 2024/0117654 A1 Apr. 11, 2024

Related U.S. Application Data

(60) Provisional application No. 63/379,028, filed on Oct. 11, 2022.

(51) Int. Cl.
*E04H 17/14* (2006.01)
*E04H 17/20* (2006.01)

(52) U.S. Cl.
CPC ..... *E04H 17/146* (2021.01); *E04H 17/145* (2021.01); *E04H 17/21* (2021.01)

(58) Field of Classification Search
CPC . E04H 17/14; E04H 17/1417; E04H 17/1426; E04H 17/143; E04H 17/145; E04H 17/146; E04H 17/16; E04H 17/1602; E04H 17/165; E04H 17/166; B23K 11/008
See application file for complete search history.

(56) References Cited

U.S. PATENT DOCUMENTS 22,994 A * 2/1859 West ..... E04H 17/16 256/31
D296,935 S * 7/1988 Erceg ..... D25/100
5,601,278 A * 2/1997 Graber ..... E04H 17/143 256/66
5,657,605 A * 8/1997 Sidney ..... F16B 7/22 403/201

(Continued)

FOREIGN PATENT DOCUMENTS

CH 346351 A * 5/1960 ..... E04H 17/14
DE 3440160 A1 * 5/1986

(Continued)

*Primary Examiner* — Jonathan P Masinick
(74) *Attorney, Agent, or Firm* — Barnes & Thornburg LLP

(57) ABSTRACT

A latticework assembly is provided. The latticework assembly includes a plurality of base laths and plurality of cross laths. Each base lath of the plurality of base laths is spaced apart from each other. The plurality of cross laths extend transverse on the plurality of base laths. Each cross lath of the plurality of cross laths includes a floor that separates opposing sidewalls extending therefrom. Each cross lath of the plurality of cross laths includes a cover. The cover includes opposing sidewalls depending from an underside of the cover; each of the opposing sidewalls of the each cross lath of the plurality of cross laths includes; wherein each of the opposing sidewalls of the cover include an outwardly directed hook. An inwardly directed hook that is engageable with the cover; and the outwardly directed hooks from the cover engage the inwardly directed hooks of the cross lath.

16 Claims, 6 Drawing Sheets

(56) References Cited

U.S. PATENT DOCUMENTS

| | | | | | |
|---|---|---|---|---|---|
| 5,803,438 | A * | 9/1998 | Blouin | E04H 17/143 | 256/65.11 |
| 6,010,117 | A * | 1/2000 | Doxey | E04H 17/143 | 256/65.01 |
| 6,470,643 | B1 * | 10/2002 | Cantley | E04H 17/1602 | 52/311.1 |
| 8,074,339 | B1 * | 12/2011 | Brandt | E04C 2/421 | 29/527.1 |
| 11,015,365 | B2 * | 5/2021 | Loucks | E04H 17/1417 | |
| 2005/0139815 | A1 * | 6/2005 | McIntosh | E04H 17/143 | 256/65.03 |
| 2022/0106747 | A1 * | 4/2022 | Ferguson | E04H 15/005 | |

FOREIGN PATENT DOCUMENTS

| | | | | | |
|---|---|---|---|---|---|
| DE | 29714136 | U1 * | 11/1997 | | |
| DE | 29922382 | U1 * | 3/2000 | E04H 17/14 | |
| DE | 10031772 | A1 * | 1/2002 | E04H 17/143 | |
| FR | 2671938 | A1 * | 7/1992 | A01G 9/12 | |
| FR | 2715426 | A1 * | 7/1995 | E04H 17/143 | |
| FR | 2715427 | A1 * | 7/1995 | E04H 17/143 | |
| GB | 620135 | A * | 3/1949 | E04H 17/165 | |
| GB | 2267296 | A * | 12/1993 | E04H 17/165 | |
| JP | 3111919 | U * | 7/2005 | E04H 17/165 | |
| KR | 20080003746 | U * | 9/2008 | E04H 17/1417 | |

* cited by examiner

LATTICE ASSEMBLY

RELATED APPLICATIONS

The present Application relates to and claims priority to U.S. Provisional Patent Application, Ser. No. 63/379,028 filed on Oct. 11, 2022. The subject matter disclosed in that Provisional Application is hereby expressly incorporated into the present Application.

TECHNICAL FIELD AND SUMMARY

The present disclosure is directed to architectural structures and, particularly, to latticework panels having concealed attachment points and additional features.

A latticework panel is a structure composed of criss-crossed strips of wood, metal, or other structural material that forms an open grid or weave. Often, barriers, such as fencing or panels, may be used to provide at least partial concealment between separated areas. The amount of concealment is based on how close the strips or laths forming the lattice are spaced apart from each other. Wood makes a suitable material for a lattice because crossing wood laths can be stapled together or, depending on the thickness of each lath, they can be woven with respect to each other to form the lattice structure.

Metal can also be made into lath or strips. The problem is attaching the metal laths together. Obviously, crossing metal laths may be bolted or otherwise fastened together. Such creates a strong joint, but, aesthetically, it may not be viable because the fastening means is visible. An adhesive, by contrast, may be deposited between crossing laths making it, conceptually, a promising alternative because sandwiching the adhesive between crossing laths means the adhesive is not readily visible. This assists with respect to aesthetics, particularly, when compared with using mechanical fasteners. Unfortunately, an adhesive may not be able to hold the crossing laths over long periods of time, especially, if used outdoors and exposed to the weather.

An illustrative embodiment of the present disclosure provides a latticework assembly. The latticework assembly includes a plurality of base laths and a plurality of cross laths. Each base lath of the plurality of base laths is spaced apart from each other. Each cross lath of the plurality of cross laths is spaced apart from each other. The plurality of cross laths extend transverse on the plurality of base laths. Each cross lath of the plurality of cross laths includes a floor that separates opposing sidewalls extending therefrom. The floor and the opposing sidewalls are longitudinally extending the each cross lath of the plurality of cross laths. The floor of the each cross lath of the plurality of cross laths includes a plurality of holes. Each hole of the plurality of holes are disposed through the floor of the each cross lath of the plurality of cross laths. The each hole of the plurality of holes is located over a corresponding base lath of the plurality of base laths. The floor of each cross lath of the plurality of cross laths is welded to the corresponding base lath at each of the plurality of holes. A peripheral surface of each hole of the plurality of holes provides a weld surface for weld material. Each cross lath of the plurality of cross laths includes a longitudinally extending cover that engages the opposing sidewalls, opposite the floor, to shroud the plurality of holes.

In the above and other embodiments, the lattice assembly may further comprise: the plurality of base laths and the plurality of cross laths are made of the same material; the plurality of base laths and the plurality of cross laths are made of a metal; each of the opposing sidewalls of the each cross lath of the plurality of cross laths includes an inwardly directed hook that is engageable with the cover from the each cross lath of the plurality of cross laths; the each cross lath of the plurality of cross laths extends across the each base lath of the plurality of base laths at a relative angle that is including and between orthogonal to parallel; the each cross lath of the plurality of cross laths extends across the each base lath of the plurality of base laths at a relative transverse angle that is about 45° with respect to each other; the each cross lath of the plurality of cross laths has a cross-sectional profile selected from the group consisting of circular, oval, square, and rectangular; the each cross lath of the plurality of cross laths has no visible attachment points with the each base lath of the plurality of base laths; the each base cross of the plurality of cross laths is made of an extruded material; the each base lath of the plurality of base laths is made of an extruded material; wherein the each cross lath of the plurality of cross laths has substantially same cross-sectional dimensions as the each base lath of the plurality of base laths; and the each cross lath of the plurality of cross laths has substantially the same cross-sectional dimensions and made of substantially the same material as the each base lath of the plurality of base laths.

Another illustrative embodiment of the present disclosure provides a latticework assembly. The latticework assembly includes a plurality of base laths and plurality of cross laths. Each base lath of the plurality of base laths is spaced apart from each other. Each cross lath of the plurality of cross laths is spaced apart from each other. The plurality of cross laths extend transverse on the plurality of base laths. Each cross lath of the plurality of cross laths includes a floor that separates opposing sidewalls extending therefrom. The floor of the each cross lath of the plurality of cross laths includes a plurality of holes. Each hole of the plurality of holes are disposed through the floor of the each cross lath of the plurality of cross laths. Each hole of the plurality of holes is located over a corresponding base lath of the plurality of base laths. The floor of the each cross lath of the plurality of cross laths is attached to the corresponding base lath at the each of the plurality of holes. Each cross lath of the plurality of cross laths includes a cover that engages the opposing sidewalls, opposite the floor, to shroud the plurality of holes. Each of the opposing sidewalls of the each cross lath of the plurality of cross laths includes an inwardly directed hook that is engageable with the cover.

In the above and other embodiments, the lattice assembly may further comprise: the floor of the each cross lath of the plurality of cross laths is attached to the corresponding base lath by a weld at the each of the plurality of holes; a peripheral surface of the each hole of the plurality of holes provides a weld surface for weld material; the floor of the each cross lath of the plurality of cross laths is attached to the corresponding base lath by a fastener at the each of the plurality of holes; each of the inwardly directed hooks of the each of the opposing sidewalls of the each cross lath of the plurality of cross laths includes a beveled surface to be located adjacent the cover; and the floor and the opposing sidewalls are longitudinally extending the each cross lath of the plurality of cross laths.

Another illustrative embodiment of the present disclosure provides a latticework assembly. The latticework assembly includes a plurality of base laths and a plurality of cross laths. Each base lath of the plurality of base laths is spaced apart from each other. The plurality of cross laths extend transverse on the plurality of base laths. Each cross lath of the plurality of cross laths includes a floor that separates opposing sidewalls extending therefrom. Each cross lath of the plurality of cross laths includes a cover. The cover includes opposing sidewalls depending from an underside of the cover; each of the opposing sidewalls of the each cross lath of the plurality of cross laths includes; wherein each of the opposing sidewalls of the cover include an outwardly directed hook; an inwardly directed hook that is engageable with the cover; and the outwardly directed hooks from the cover engage the inwardly directed hooks of the cross lath.

In the above and other embodiments, the lattice assembly may further comprise the floor of the each cross lath of the plurality of cross laths includes a plurality of holes, wherein the each hole of the plurality of holes is located over a corresponding base lath of the plurality of base laths, wherein the floor of the each cross lath of the plurality of cross laths is attached to the corresponding base lath at the each of the plurality of holes, and wherein the cover for each cross laths of the plurality of cross laths shrouds the plurality of holes.

Additional features and advantages of the lattice assembly will become apparent to those skilled in the art upon consideration of the following detailed descriptions of carrying out the lattice assembly as presently perceived.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels may be repeated among the figures to indicate corresponding or analogous elements.

Corresponding reference characters indicate corresponding parts throughout the several views. The exemplification set out herein illustrates embodiments of the lattice assembly, and such exemplification is not to be construed as limiting the scope of the lattice assembly, in any manner.

DETAILED DESCRIPTION OF THE DRAWINGS

Figure 1:
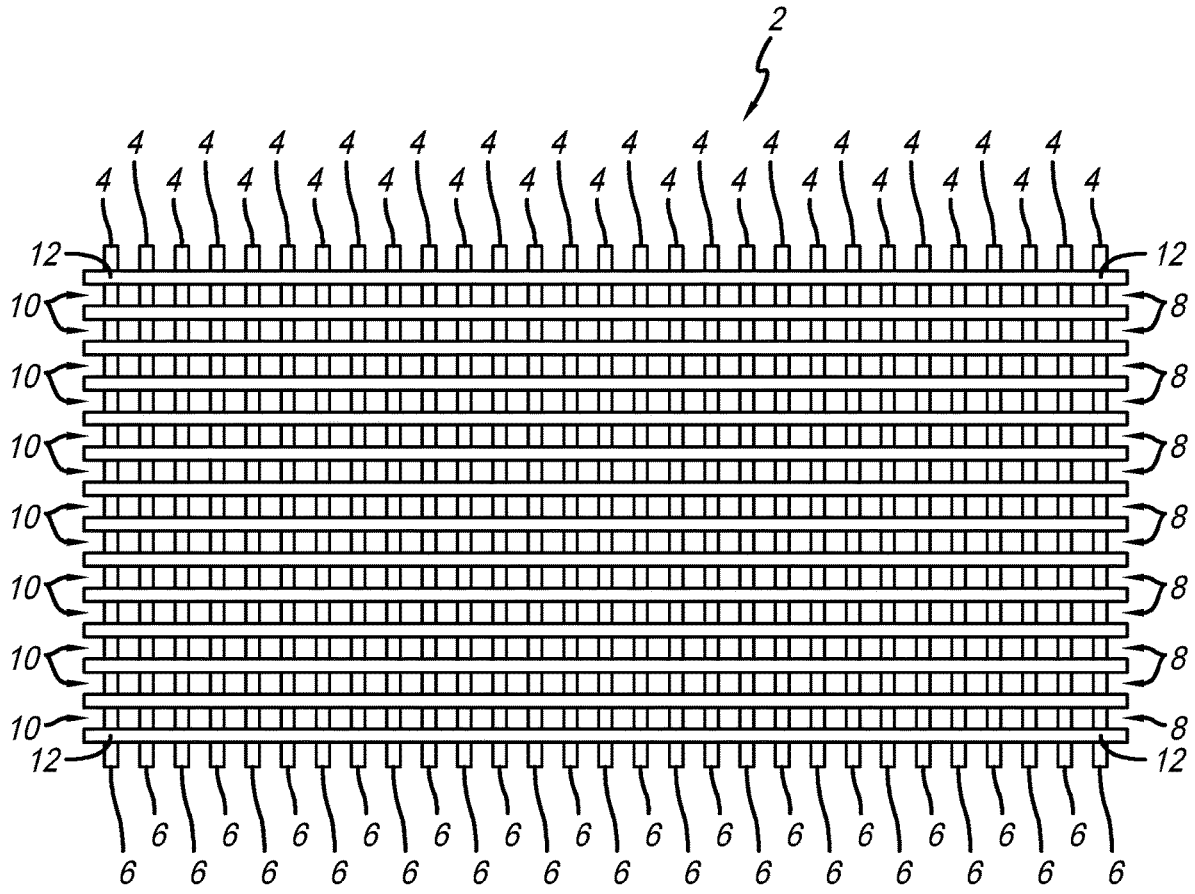
FIG. 1 is a front view of an illustrative embodiment of an exemplary lattice assembly.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

An illustrative embodiment of the present disclosure provides a metal latticework structure composed of a series of crisscrossing metal laths. The lattice structure may be composed of a series of base laths spaced apart from each other. Illustratively, the number of laths used may be as few as one to any number more. There is no upper limit on the number of base laths that may be employed to form a desired lattice structure. Extending transverse to the base laths are one or more cross laths. When a plurality of cross laths are used, they may be spaced apart any desired distance from each other, as they cross the base laths. It is contemplated that the cross laths may extend across the base laths at any desired angle, such as between, and including, orthogonal to parallel. Typically, the cross laths may be about perpendicular to the base laths, or some angle, less or more, such as about 45° with respect to the base laths. It is appreciated and contemplated herein that the angle with which one or more cross laths can be oriented with respect to the base lath, while located on top, may be any angle.

In the illustrative embodiment, the cross lath may include one or more openings disposed through the floor of same at a location where the cross lath will be welded to the base lath. This means in some circumstances, openings will be disposed through the floor at spaced apart intervals that align with multiple base laths so the cross lath can be welded to each of the base laths. The number of openings and distance therebetween will be determined by the number of base laths employed and the number of those base laths that the cross lath is intended to be welded onto. This can be repeated for each cross lath being attached to the base laths. Additionally, the openings in the cross lath can be of any variety, such as circular, oval, square, rectangular, etc. The opening is to assist creating weld surfaces for both the cross lath and base lath that a weld material can engage for connecting them together.

Because creating metal lattices means the connection between crossing metal laths are visible and detract from the aesthetic of the lattice, the cross lath in this disclosure may be capped with a strip of either the same or different material to cover the one or more weld points where the base and cross laths are attached. In addition to the openings, each cross lath may include sidewalls upwardly extending from the floor and spaced apart to form longitudinal peripheries of the cross lath. This forms a U-shaped channel that can be capped with the longitudinally extending cover engaging the upwardly extending sidewalls. In a further illustrative embodiment, the sidewalls extending from the floor include a longitudinally extending hook on each sidewall that corresponds with a longitudinally extending receiver on each side of the cover that engage each other in order to secure the cover onto the cross lath. In this form, the cross lath has the appearance of a unitary structure showing no outward signs of attachment points with the base laths. In another embodiment, the cover may include downwardly depending sidewalls and attached to receivers extending from the floor of the base lath to create the appearance of a unitary extruded-type panel.

In illustrative embodiments, the cross-section of the base lath may have the appearance of an extruded unitary panel with a polygonal shape, such as rectangular, square, etc. It is appreciated, however, that the extruded cross-section of the base panel may be of any desired shape. Both the cross lath and cover may be extruded as well. Additionally, the components of the cross lath may have cross-sectional dimensions substantially similar to the cross-section of the base lath so the relative sizes of the base lath and cross lath appear to be at least about the same. This assists with the aesthetics of the lattice giving the impression that the base lath and cross lath are of the same material and sized to offer a uniform appearance to the lattice. However, in alternate embodiments, if it is so desired, the cross-sectional shape of the assembled components of the cross lath may be different than the cross-sectional shape of the base lath if such different cross-sectional shapes achieve the desired aesthetic.

A front view of an illustrative embodiment of exemplary lattice assembly 2 is shown in FIG. 1. As depicted, lattice assembly 2 is composed of a plurality of base laths 4, each spaced apart, as shown. To that end, a space 6 is created between adjacent base laths 4 as also shown. It will be appreciated by the skilled artisan upon reading this disclosure that any number of base laths may be used from 1 to 100 or even more. The lengths of each of base laths 4, as well as their widths, may be dimensioned as needed for the particular lattice assembly design desired. Similarly, space 6, between base laths 4, when more than one are used, may be any width.

Crisscrossing base laths 4, depicted herein, are cross laths 8. Like base laths 4, cross laths 8 may be employed in any number from 1 to 100 or more. Similarly, the length and width of each cross lath 8 may be dimensioned as needed to achieve any desired aesthetic. Additionally, like space 6, space 10 extends between each pair of cross laths 8, a distance sufficient to view base lath 4 underneath cross lath 8. It is appreciated that the width and length of space 10 may be dimensioned to any size to create a desired aesthetic. It is appreciated that adjacent cross laths 8 may abut each other making the width of space 10 negligible or be doubled, tripled, or any other multiple in size spacing apart cross laths 8 if the desired aesthetic so dictates. What is not visible from this view, is any means for attaching one or more cross laths 8 to one or more base laths 4. Cross laths 8 cross over base laths 4 and connect together, but that means of attachment is visually not apparent. In contrast to other lattices where the attachment means are visible, in this disclosure, no such connecting means is visible from this front view.

It will be appreciated by the skilled artisan upon reading this disclosure that the depicted design of lattice assembly 2, shown here in FIG. 1, is illustrative only. Not only may such a lattice assembly be composed of one or more cross laths 8 laying over one or more base laths 4, but the angle or angles cross lath 8 extends over base lath 4 may vary. The illustrated view herein shows cross laths 8 oriented about orthogonal to base laths 4. It is appreciated, however, that cross laths 8 may extend over base laths 4 at any angle, such as 45°, 65°, etc. It is contemplated that one or more cross laths may extend over one or more base laths at any angle ranging from 0° to 360°, again depending on the aesthetic that is desired to be achieved. Expressly, the variety of lattice assembly designs that may employ the disclosure herein is too numerous to catalog herein. Nevertheless, such designs are contemplated herein and within the scope of the present disclosure.

Figure 2:
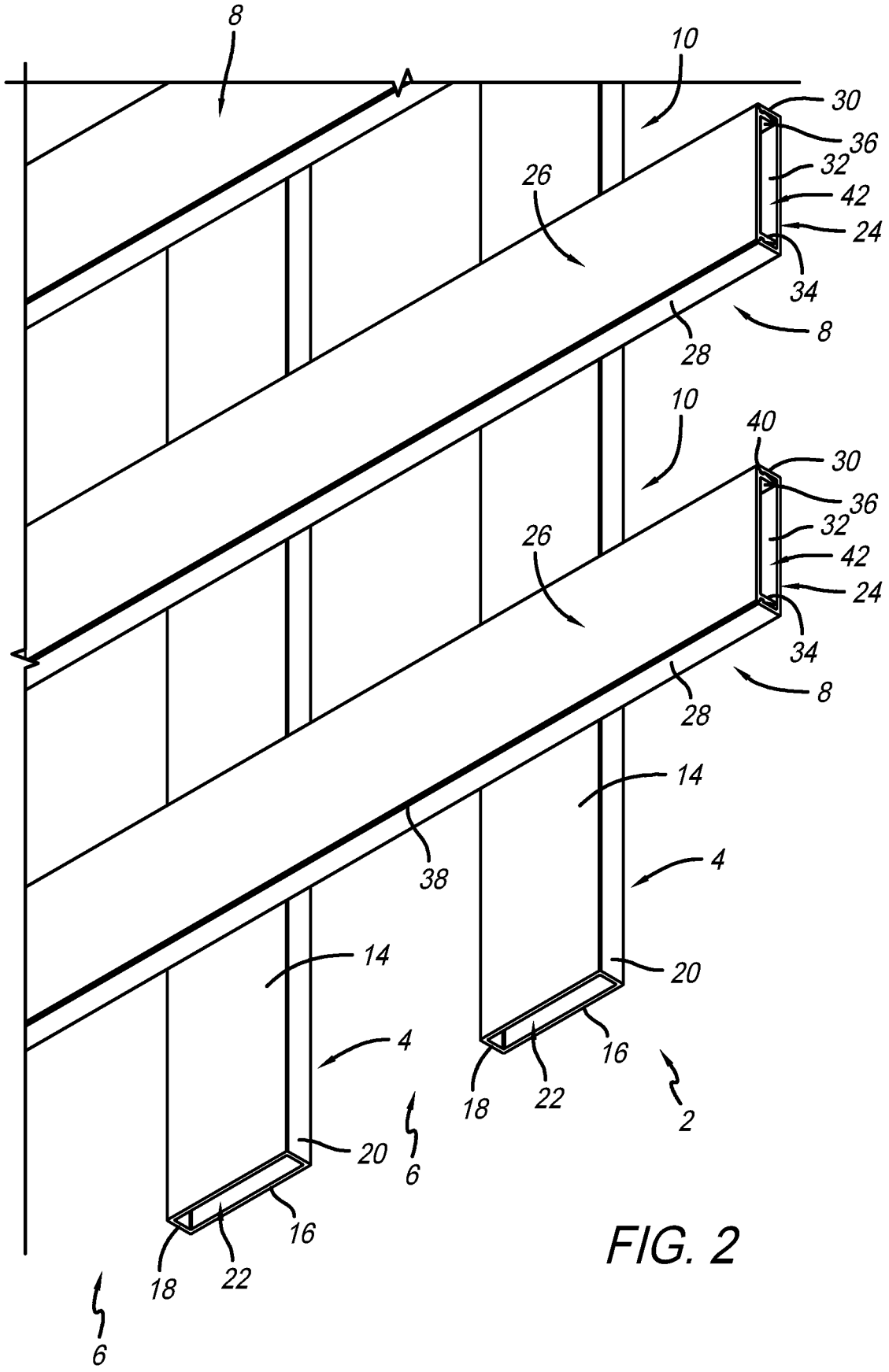
FIG. 2 is a detail perspective view of a portion of the lattice assembly.

A detail perspective view of a portion of lattice assembly 2 is shown in FIG. 2. The illustrative embodiment shows a plurality of cross laths 8 disposed over a plurality of base laths 4. Each of the base laths 4 are spaced apart from each other as indicated by space 6, whereas cross laths 8 are spaced apart from each other as indicated by space 10. It is appreciated from this view how cross laths 8 lay over base laths 4, but there are no readily visible attachment means securing them together. As such, this view further illustrates the aesthetic created by concealing the attachment means between base lath 4 and cross lath 8. This view also illustrates the cross-sectional shapes of base lath 4 and cross lath 8. For example, with respect to base lath 4, it has a rectangular cross section. The center is hollow, indicative of an extruded plank. Illustratively, base lath 4, may be formed via an extrusion, molding—such as injection molding, press braking a sheet, metal roll forming, and the like. Further, in an illustrative embodiment, the material that base lath 4 may be made from includes a metal, such as aluminum, a polymer, or other like suitable materials. Additionally, the cross-sectional profile of the longitudinally extending base lath 4 may be rectangular as shown herein, or square, polygonal, oval, circular, or curved. The rectangularly-shaped cross-section of base lath 4, shown herein, is employed for illustrative purposes to further describe the disclosure. Other profiles, materials, and manufacturing methods may be employed herein as well.

As shown, each base lath 4 is composed of front facing 14 and rear facing 16 with sidewalls 18 and 20 extending therebetween to create an open space for bore 22 within the structure. This provides an aesthetic presence for base lath 4's portion of lattice assembly 2. Being illustratively hollow inside, though optional, may reduce the weight of lattice assembly 2 as well.

With respect to cross laths 8, they may include a similar, if not substantively identical, shape and cross-section to base lath 4 to provide the appearance that base lath 4 and cross lath 8 are the same plank-type structures, just crossing each other to form lattice assembly 2. It is appreciated that it is not required, particularly within the context of this disclosure that cross lath 8 have the similar or same appearance as base lath 4. That is based on the aesthetic design intended for the lattice assembly. It is further appreciated that this disclosure may be employed with such variety of different or same shapes, materials, lengths, and thicknesses desired to achieve a particular aesthetic design for lattice assembly 2.

As further shown in FIG. 2, cross lath 8 is made from illustratively multiple components, including a longitudinally extending U-shaped channel member 24 and a cover member 26. Capping U-shaped channel member 24 is illustratively shown. In this illustrative embodiment, outward extending sidewalls 28 and 30 extend from a floor 32 of U-shaped channel member 24 as illustratively shown. With respect to cover member 26, it includes outwardly extending flanges 34 and 36 that engage outwardly extending sidewalls 28 and 30, respectively, to secure cover member 26 to U-shaped channel member 24. It will be appreciated by the skilled artisan upon reading this disclosure that sidewalls 28 and 30, as well as flanges 34 and 36, are illustratively oriented, and in other embodiments, may be reversed. For example, cover member 26 may include outwardly extending sidewalls 28 and 30, while U-shaped channel member 24 may include outwardly extending flanges 34 and 36, to engage extending sidewalls 28 and 30, respectively. Because, in this illustrative embodiment, a seam, such as seams 38 and 40, may be longitudinally formed between cover member 26 and U-shaped channel member 24, depending on the aesthetic design desired, those seams may be positioned in the location shown or opposite adjacent floor 32. The orientation and positioning of cover member 26, with respect to U-shaped channel member 24, is illustrative for purposes of explaining the disclosure.

In addition, U-shaped channel member 24 and cover member 26 form a bore 42, similar to bore 22, and is disposed through base lath 4. It is appreciated, however, that the lath shapes, profiles, and materials may be the same or different as base lath 4, depending on the particular aesthetic design intending to be achieved by lath 2.

Figure 3:
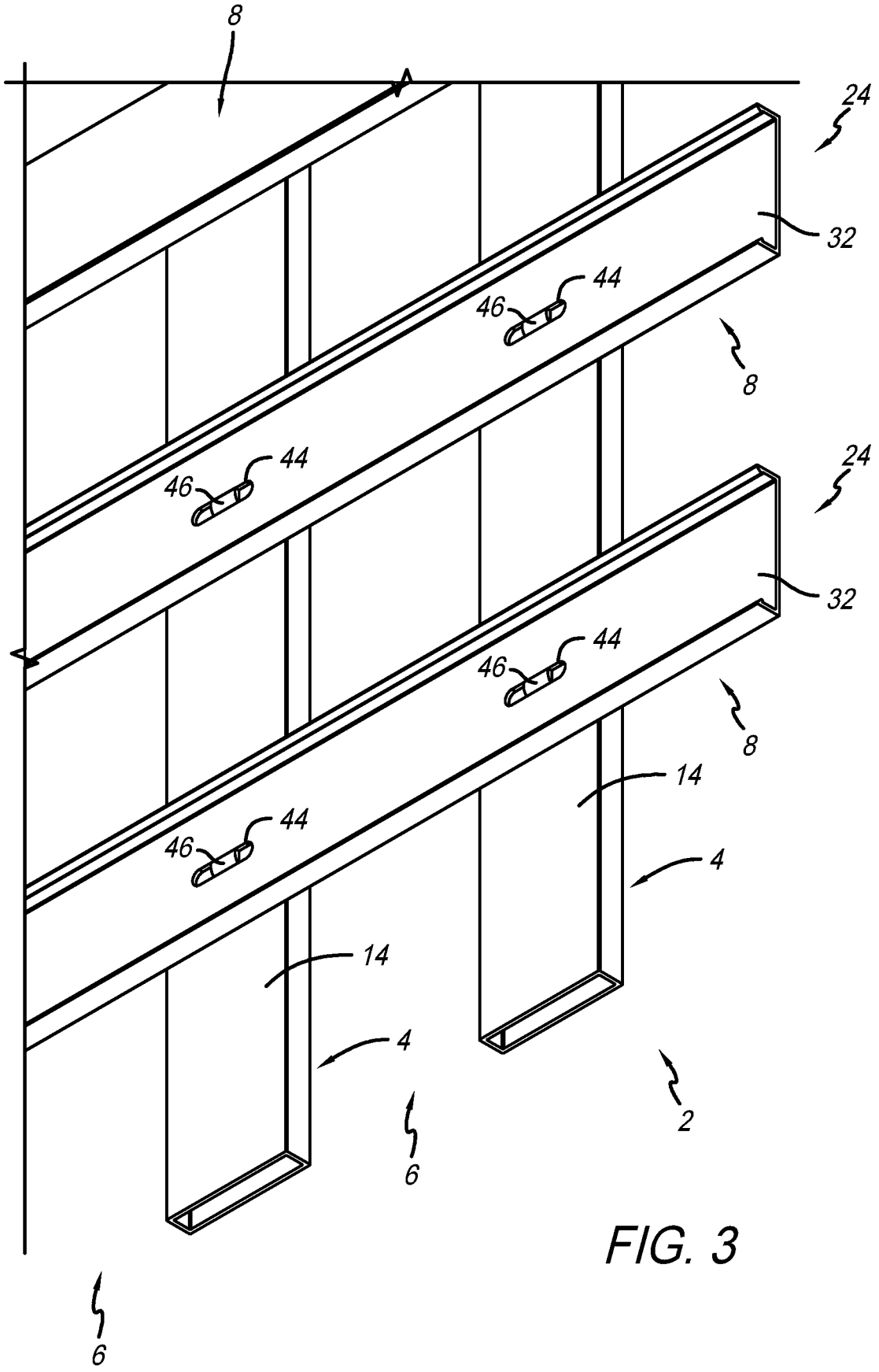
FIG. 3 is another detail perspective view of a portion of the lattice assembly.

Another detail perspective view of a portion of lattice assembly 2 is shown in FIG. 3. This view is similar to that of FIG. 2 in that base laths 4 are similarly shown with spaces 6 therebetween. A distinction, however, is cover member 26 of cross laths 8, as shown in FIG. 2, is removed to expose U-shaped member 24 for demonstrative purposes. This view demonstrates how the cross laths 8 are attached to base laths 4. Opening 44 is disposed through floor 32 of U-shaped channel members 24. The skilled artisan upon reading this disclosure will appreciate that one or more such openings 44 may be disposed through floor 32, depending on the number of base laths 4 the particular cross lath 8 will be attached to.

Illustratively, and as shown herein, multiple openings 44 are disposed through floor 32 since cross lath 8 will be attached to a corresponding number of base laths 4. It is further appreciated that only a select number of openings 44 will be disposed through floor 32, depending on the configuration and use of the base lath 4. For example, if a base lath 4 is intended to move with respect to a particular cross lath 8, no opening 44 is needed to be disposed therethrough. Alternatively, opening 44 may nevertheless be disposed through floor 32, but no weld bead deposited in opening 44. As shown in the illustrated embodiment, weld bead 46 is deposited in opening 44 and onto front facing 14 of base lath 4. Weld bead 46, contacting the periphery of opening 44 of floor 32, and front facing 14, attaches base lath 4 and cross lath 8 together. As shown herein, multiple openings 44, each with a weld bead 46 therein, may secure multiple cross laths 8 to multiple corresponding base laths 4. It is further appreciated that other securement means may be employed to attach one or more cross laths 8 to one or more base laths 4. For example, opening 44 may be a circular hole or threaded hole sized to receive a fastener, such as a bolt, that may also be disposed through a corresponding hole and facing 14 of base lath 4. In this instance, cross lath 8 may not necessarily be permanently affixed to a base lath 4. Instead, fasteners may be added or removed to opening 44, with respect to base lath 4, to proffer the desired attachment points between base lath 4 and cross lath 8. There may be instances where lattice designs dictate that certain attachment points exist between cross lath 8 and base lath 4, but not other securement points. Additionally, it may be necessary or desired to change the configuration of a base lath 4 and cross lath 8 to create multiple or custom lattice designs, where having the flexibility of attaching or detaching cross lath 8 from base lath 4, may have utility.

Figure 4:
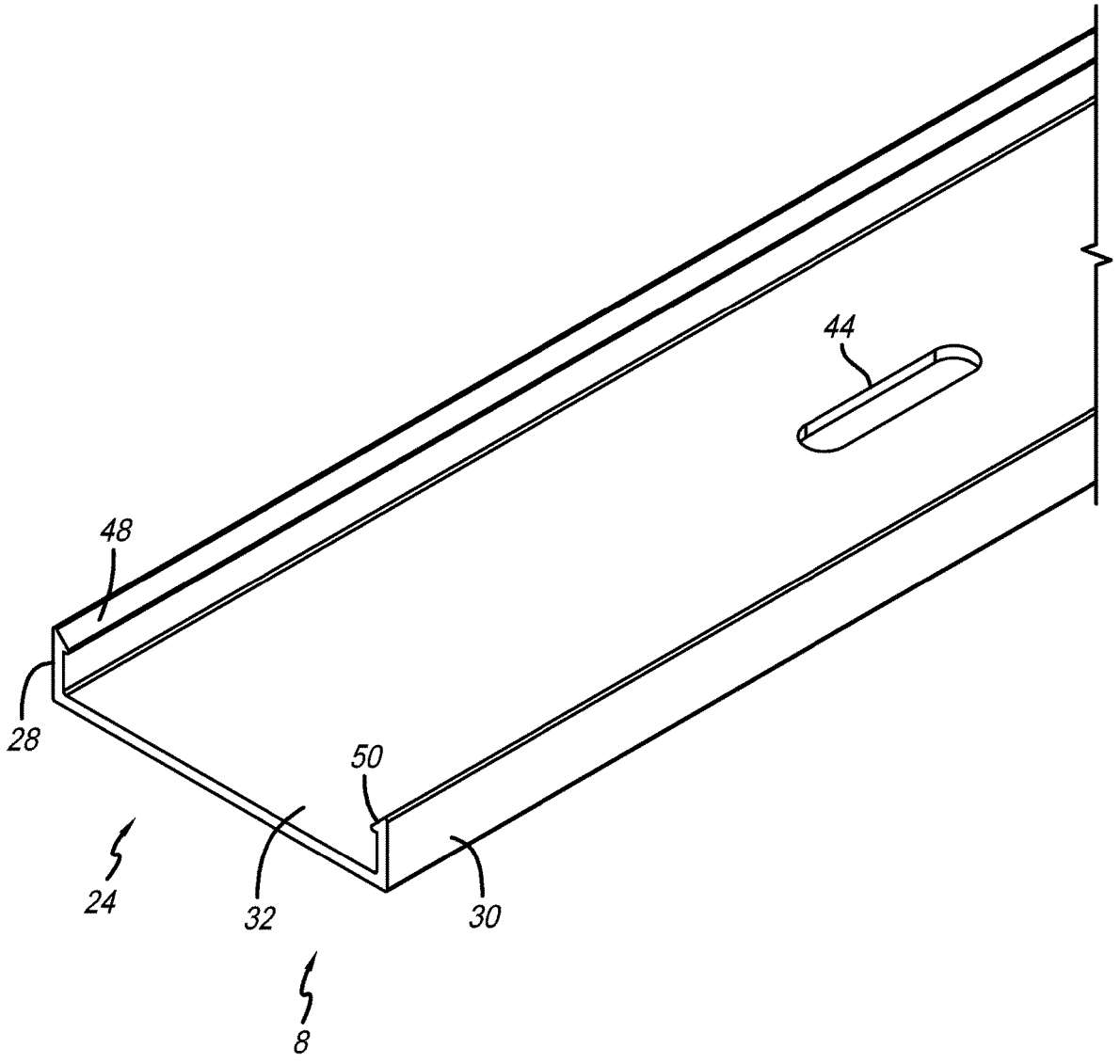
FIG. 4 is a perspective view of a portion of a cross lath with a cover member removed to expose an opening disposed through the floor of the cross lath.

A perspective view of a portion of a cross lath 8, with cover member 26 removed to expose opening 44 disposed through floor 32, is shown in FIG. 4. Also depicted herein are sidewalls 28 and 30 extending outwardly from and at the periphery of floor 32. Extending from each of sidewalls 28 and 30, towards the upper end of same, are attachment hooks 48 and 50, respectively. Hooks 48 and 50 may extend a partial length or the entire longitudinal extent of sidewalls 28 and 30, respectively. It is appreciated that hooks 48 and 50 will engage complementary structures located in flanges 34 and 36, respectively, of cover member 26. This connection secures cover member 26 onto U-shaped channel member 24 to form cross lath 8. Other connection means include, but not limited to; welding, adhesive, bolts, screws, rivets, or other similar fasteners.

Figure 5:
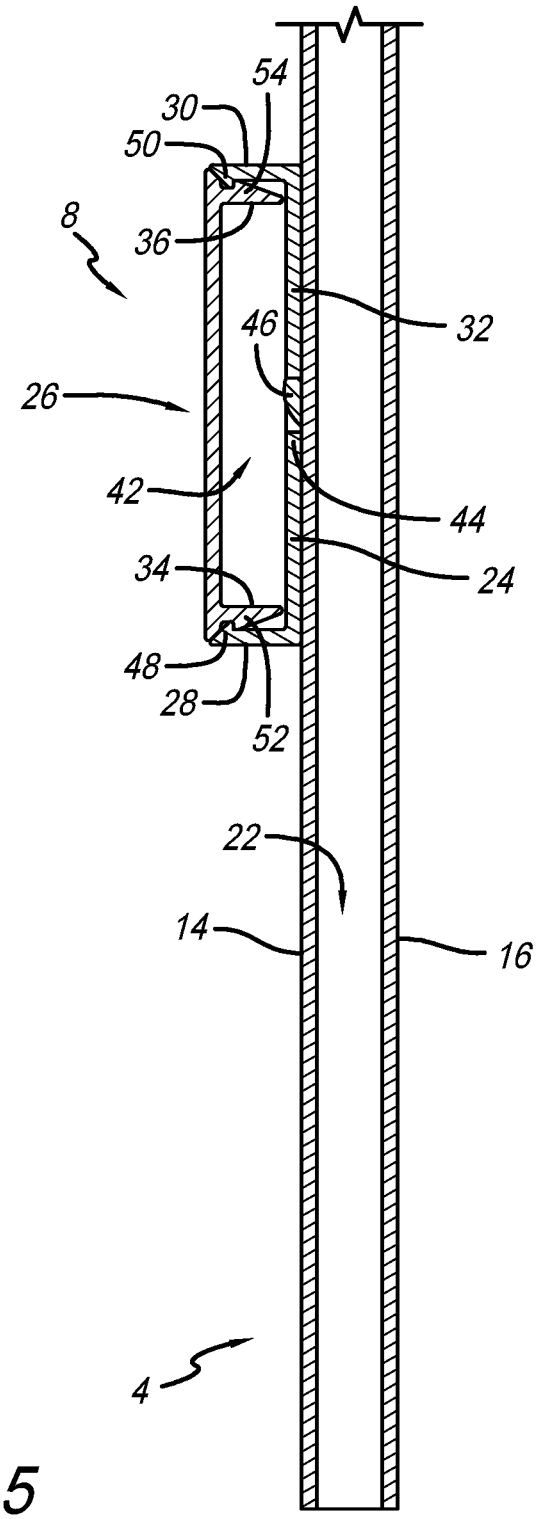
FIG. 5 is a cross sectional view of a portion of the lattice assembly.

A cross sectional view of a portion of lattice assembly 2 is shown in FIG. 5. In this view, a cross section of both base lath 4 and cross lath 8 are shown in addition to the connection with each other. Front facing 14 and rear facing 16 of base lath 4 is shown with bore 22 disposed therebetween. Cross lath 8, sitting on top, shows opening 44 disposed through floor 32 with weld bead 46 deposited therein creating attachment between front facing 14 of base lath 4 and floor 32 of cross lath 8. This view also shows outward extending sidewalls 28 and 30 extending from floor 32 forming U-shaped channel member 24 of cross lath 8. Cover member 26 is fitted over U-shaped member 24 with bore 42 disposed therebetween. Extending from cover member 26 is outwardly extending flanges 34 and 36, as illustratively shown. Illustrative attachment hooks 52 and 54 are formed on outwardly extending flanges 34 and 36, respectively, sized and configured to matingly engage with corresponding attachment hooks 48 and 50 of outward extending sidewalls 28 and 30, respectively. It is appreciated that these attachment hooks may extend the length of the outwardly extending sidewalls or flanges. Alternatively, the attachment hooks may only extend partway along the longitudinal lengths of U-shaped channel member 24 and cover member 26. It is appreciated from this view how the attachment means, illustratively here, weld bead 46 disposed in opening 44, and is concealed when cover member 26 is secured to U-shaped channel member 24. This provides a clean uniform aesthetic to the resulting lattice assembly 2.

Figure 6:
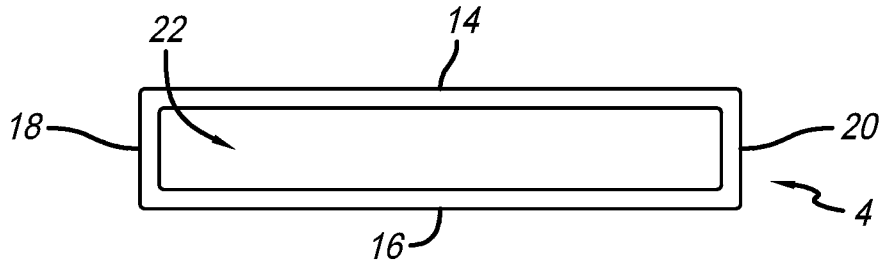
FIG. 6 is an end view of a base lath.

An end view of base lath 4 is shown in FIG. 6. This view further depicts an illustrative cross sectional shape for base lath 4, composed of front facing 14 opposite rear facing 16, with sidewalls 18 and 20 extending therebetween. Bore 22 is longitudinally extending within base lath 4 and formed by the facings and walls and sized contingent on same. It is appreciated that bore 22 may have various functions, including electrical conduits or raceways.

Figure 7:
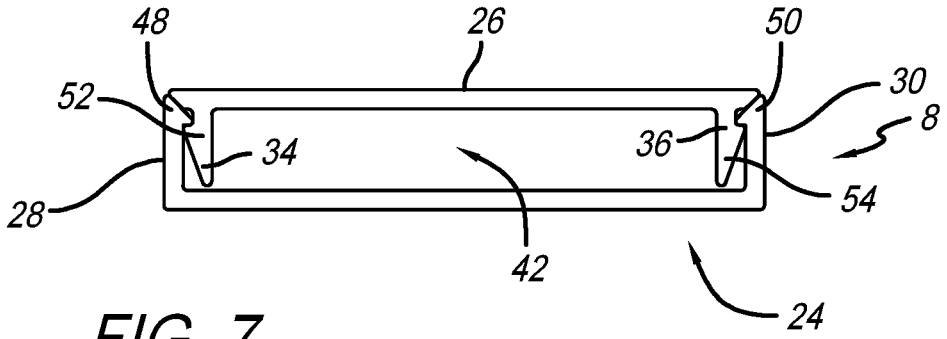
FIG. 7 is an end view of a cross lath.
Figure 8:
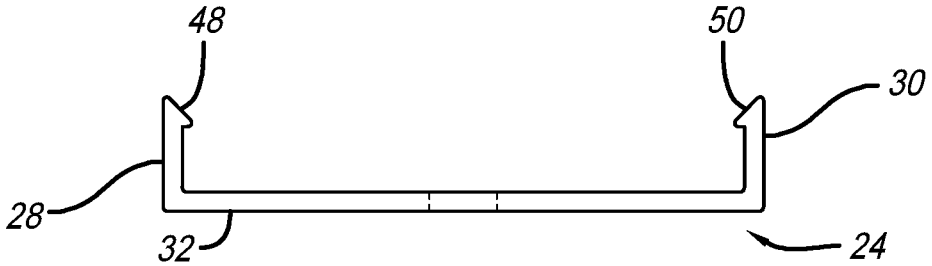
FIG. 8 is an end view of a U-shaped channel member of the cross lath.
Figure 9:
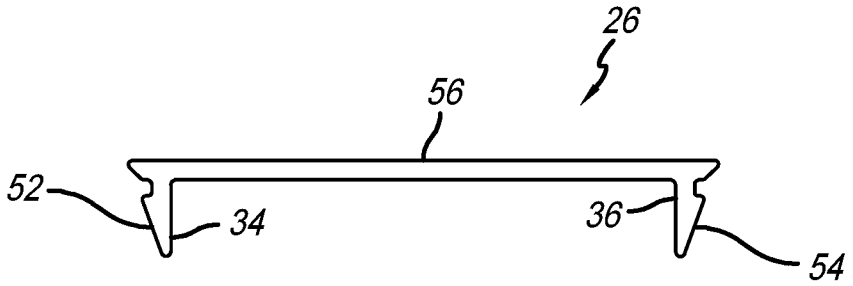
FIG. 9 is an end view of a cover member of the cross lath.

An end view of cross lath 8, as well as portions of same, including U-shaped channel member 24 and cover member 26, are shown in FIGS. 7, 8, and 9, respectively. As shown in FIG. 7, attachment hooks 52 and 54 of outwardly extending flanges 34 and 36 engage attachment hooks 48 and 50 of sidewalls 28 and 30. Cover member 26 shrouds bore 42 located between same and U-shaped channel member 24. Bore 42, like bore 22, may also be used as a conduit or raceway. Additionally, cover member 26 may be made of the same or similar material as U-shaped channel 24 and is configured to lock into place. If both U-shaped channel member 24 and cover member 26 have their outer surfaces coated the same (such as a powder coating), the fact that they are separate pieces connected together might not be as readily apparent. Again, this assists in creating an anesthetic for lattice assembly 2 that does not reveal the means of attachment between base lath 4 and cross lath 8. Alternatively, in other embodiments, cover member 26 may be made of an alternate material, such as a flexible polymer material, that allows cover member 26 to be disassembled from U-shaped channel member 24.

The views of U-shaped channel member 24 and cover member 26 are individually shown in FIGS. 8 and 9, respectively. As shown in FIG. 8, sidewalls 28 and 30 are shown extending from floor 32 with opening 44 disposed therethrough. This view also shows the illustrative nature of attachment hooks 48 and 50 at about the ends of sidewalls 28 and 30, respectively. Similarly, cover member 26 is shown with depending flanges 34 and 36 extending from cap member 56 of cover member 26. In the illustrative embodiment, attachment hooks 52 and 54 are located adjacent cap member 56 so, when mated with attachment hooks 48 and 50, respectively, cap member 56 will set on sidewalls 28 and 30 to create cross lath 8. It is appreciated that the attachment hooks may have beveled surfaces so as to allow the mating process between U-shaped channel member 24 and cover member 26 be easier, as well as potentially minimizing the visibility of seam 38 that may form therebetween (see, also, FIG. 2).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features. It should also be appreciated that any subject matter disclosed in this non-provisional patent application that may differ from the priority application, then the disclosure from this non-provisional patent application controls.

What is claimed:

1. A latticework assembly comprising:

a plurality of base laths;

wherein each base lath of the plurality of base laths is spaced apart from each other; and a plurality of cross laths;

wherein each cross lath of the plurality of cross laths is spaced apart from each other;

wherein the plurality of cross laths extend transverse on the plurality of base laths;

wherein each cross lath of the plurality of cross laths includes a floor that separates opposing sidewalls extending therefrom;

wherein the floor and the opposing sidewalls are longitudinally extending the each cross lath of the plurality of cross laths;

wherein the floor of the each cross lath of the plurality of cross laths includes a plurality of holes disposed through the floor of the each cross lath of the plurality of cross laths;

wherein the each hole of the plurality of holes is located over a surface of a corresponding base lath of the plurality of base laths such that a periphery of the each hole of the plurality of holes is positioned adjacent to and surrounds the surface of a corresponding base lath of the plurality of base laths;

wherein the floor of the each cross lath of the plurality of cross laths is welded to the surface of the corresponding base lath at the each of the plurality of holes;

wherein a peripheral surface of the each hole of the plurality of holes and the surface of the corresponding base lath provide a weld surface for weld material; and wherein the each cross lath of the plurality of cross laths includes a longitudinally extending cover that engages the opposing sidewalls opposite the floor to shroud the plurality of holes.

2. The latticework assembly of claim 1, wherein the plurality of base laths and the plurality of cross laths are made of the same material.

3. The latticework assembly of claim 1, wherein the plurality of base laths and the plurality of cross laths are made of a metal.

4. The latticework assembly of claim 1, wherein each of the opposing sidewalls of the each cross lath of the plurality of cross laths includes an inwardly directed hook that is engageable with the cover from the each cross lath of the plurality of cross laths.

5. The latticework assembly of claim 1, wherein the each cross lath of the plurality of cross laths extends across the each base lath of the plurality of base laths at a relative angle that is including and between orthogonal to parallel.

6. The latticework assembly of claim 1, wherein the each cross lath of the plurality of cross laths extends across the each base lath of the plurality of base laths at a relative transverse angle that is about 45° with respect to each other.

7. The latticework assembly of claim 1, wherein the each cross lath of the plurality of cross laths has a cross-sectional profile selected from the group consisting of circular, oval, square, and rectangular.

8. The latticework assembly of claim 1, wherein the each cross lath of the plurality of cross laths has no visible attachment points with the each base lath of the plurality of base laths.

9. The latticework assembly of claim 1, wherein the each cross lath of the plurality of cross laths is made of an extruded material.

10. The latticework assembly of claim 1, wherein the each base lath of the plurality of base laths is made of an extruded material.

11. The latticework assembly of claim 1, wherein the each cross lath of the plurality of cross laths has substantially same cross-sectional dimensions as the each base lath of the plurality of base laths.

12. The latticework assembly of claim 1, wherein the each cross lath of the plurality of cross laths has substantially same cross-sectional dimensions and made of substantially same material as the each base lath of the plurality of base laths.

13. A latticework assembly comprising:

a plurality of base laths;

wherein each base lath of the plurality of base laths is spaced apart from each other; and a plurality of cross laths;

wherein each cross lath of the plurality of cross laths is spaced apart from each other;

wherein the plurality of cross laths extend transverse on the plurality of base laths;

wherein each cross lath of the plurality of cross laths includes a floor that separates opposing sidewalls extending therefrom;

wherein the floor of the each cross lath of the plurality of cross laths includes a plurality of holes disposed through the floor of the each cross lath of the plurality of cross laths;

wherein the each hole of the plurality of holes is located over a surface of a corresponding base lath of the plurality of base laths such that a periphery of the each hole of the plurality of holes is positioned adjacent to and surrounds the surface of a corresponding base lath of the plurality of base laths;

wherein the floor of the each cross lath of the plurality of cross laths is attached to the surface of the corresponding base lath at the each of the plurality of holes;

wherein the each hole of the plurality of holes and the surface of the corresponding base lath located adjacent to and bounded by the each hole provide securement surfaces for weld material;

wherein the each cross lath of the plurality of cross laths includes a cover that engages the opposing sidewalls opposite the floor to shroud the plurality of holes; and wherein each of the opposing sidewalls of the each cross lath of the plurality of cross laths includes an inwardly directed hook that is engageable with the cover.

14. The latticework assembly of claim 13, wherein each of the inwardly directed hooks of the each of the opposing sidewalls of the each cross lath of the plurality of cross laths includes a beveled surface to be located adjacent the cover.

15. The latticework assembly of claim 13, wherein the floor and the opposing sidewalls are longitudinally extending the each cross lath of the plurality of cross laths.

16. A latticework assembly comprising:

a plurality of base laths;

wherein each base lath of the plurality of base laths is spaced apart from each other; and a plurality of cross laths;

wherein each cross lath of the plurality of cross laths is spaced apart from each other;

wherein the plurality of cross laths extend transverse on the plurality of base laths;

wherein each cross lath of the plurality of cross laths includes a floor that separates opposing sidewalls extending therefrom;

wherein the each cross lath of the plurality of cross laths includes a cover;

wherein the cover includes opposing sidewalls depending from an underside of the cover;

wherein each of the opposing sidewalls of the cover include an outwardly directed hook;

wherein each of the opposing sidewalls of the each cross lath of the plurality of cross laths includes an inwardly directed hook that is engageable with the cover; and wherein the outwardly directed hooks from the cover engage the inwardly directed hooks of the cross lath;

wherein the floor of the each cross lath of the plurality of cross laths includes a plurality of holes disposed through the floor of the each cross lath of the plurality of cross laths, wherein the each hole of the plurality of holes is located over a surface of a corresponding base lath of the plurality of base laths such that a periphery of the each hole of the plurality of holes is positioned adjacent to and surrounds the surface of a corresponding base lath of the plurality of base laths; and wherein the floor of the each cross lath of the plurality of cross laths is welded to the surface of the corresponding base lath at the each of the plurality of holes.

* * * * *